United States Patent [19]

Pauer et al.

[11] Patent Number: 4,766,821

[45] Date of Patent: Aug. 30, 1988

[54] TABLE LEG SECUREMENT DEVICE

[75] Inventors: Jericho P. Pauer, Onalaska; Harry T. Janke, Galesville, both of Wis.

[73] Assignee: Ashley Furniture Industries, Inc., Arcadia, Wis.

[21] Appl. No.: 129,608

[22] Filed: Dec. 7, 1987

[51] Int. Cl.[4] ..... F16M 11/16

[52] U.S. Cl. ..... 108/156; 248/188

[58] Field of Search ..... 108/156, 111, 107, 155, 108/157, 153, 90, 112; 248/188

[56] References Cited

U.S. PATENT DOCUMENTS

| | | | |
|---|---|---|---|
| 110,013 | 12/1870 | Cougle . | |
| 515,382 | 2/1894 | Vankirk et al. . | |
| 642,962 | 2/1900 | Danner . | |
| 692,506 | 2/1902 | Ecker . | |
| 772,462 | 10/1904 | Gruender . | |
| 1,120,322 | 12/1914 | Metcalf | 108/155 |
| 1,208,924 | 12/1916 | Deming | 108/156 |
| 1,453,171 | 4/1923 | Oberwarth . | |
| 1,464,440 | 8/1923 | Monroe | 108/112 |
| 1,520,517 | 12/1924 | Thomason . | |
| 1,644,336 | 10/1927 | Gunlocke et al. . | |
| 1,747,691 | 2/1930 | Bellows | 108/156 X |
| 1,945,197 | 1/1934 | Koch et al. | 108/156 |
| 2,143,542 | 1/1939 | Clarin | 248/188 |
| 2,369,930 | 2/1945 | Wagner, Sr. . | |
| 2,615,770 | 10/1952 | Curtis . | |
| 3,409,258 | 11/1968 | Carlson | 108/156 X |
| 4,124,186 | 11/1978 | Call, Sr. | 248/188 |

OTHER PUBLICATIONS

Allred Metal Stamping Works Inc., High Point, N.C. A95 Leg Bracket.

Selby Furniture Hardware Co., Inc., New York, N.Y. Table Apron Leg Bracket.

S & K Products, Colewater, Ohio, K-D Brkt. Nos. 6198, 190, 17, 13, 16, 12, 95, 150, 202, 20?, 134, 135, 136, 137, 138, 139, 140, 200, 204, 107, 468, 468-2, 96, 600, 65 65F 65FN, B6 JDB6, B2 JDB2, 19-19N, B1 WMB1, 5,7,20, JDB-1, MB2 WMB2 NMB2, B-4 JDB-4, WMB 306.

*Primary Examiner*—Peter A. Aschenbrenner

*Attorney, Agent, or Firm*—Peterson, Wicks, Nemer & Kamrath

[57] ABSTRACT

A table leg securement device is disclosed including the ends of adjacent apron sections sandwiched between a corner block and a table leg. In the most preferred forms, the apron sections may be placed in a flat, shipping position and in a perpendicular position to the table top by hinges or by a dovertail interconnection. To avoid interference, the apron section are hinged by offset and butt type hinges to pivot away and toward the center of the table top in its most preferred form. The corner block includes tabs sandwiched between the table top and the edges of the apron sections. The corner block in its preferred form is channel-shaped and includes flange portions which are received in and engaged by slots formed in the first ends of the first and second apron sections for simultaneously forcing the first ends of the apron sections against the first end of the table ends of the apron sections against the first end of the table leg while maintaining the longitudinal axis of the table leg perpendicular to the longitudinal axes of the first and second apron sections when the corner block is attached to the table leg.

20 Claims, 1 Drawing Sheet

TABLE LEG SECUREMENT DEVICE

BACKGROUND

The present invention relates generally to table leg securement devices and particularly to securement devices for tables having apron sections located on the underside of the table top.

The method of securement of a table leg will determine the long term sturdiness of the table. In addition, the ease of implementing the securement method may affect the cost of shipping the table from the manufacturer to the customer. This is the case because it will usually be desirable to ship the table in the smallest possible shipping carton. However, the desire for a small shipping carton must be weighed against the amount of assembly that will be required of the customer. That is, in order to directly ship tables to customers selected from the general public, the customers must be capable of easily assembling the table in the proper way with a minimum of instruction and a minimum of tools. Therefore, with certain securement methods, more factory assembly may be done with the result that a larger shipping carton is needed.

In the past, various methods have been used to secure a table leg and adjacent apron sections to a table top. The upper end of the table leg has been attached directly to the underside of the table top and the apron sections have been separately attached to the underside of the table top. With this method, the butt joint of the upper end of the table leg against the underside of the table top must be quite strong. This joint is subject to high forces when the table is in use and when the table is moved by sliding it across the floor. In addition, this method does not allow a flat shipping package since the apron sections remain attached to the table top.

A mitered corner block has been used to maintain the position of the ends of adjacent apron sections against the upper end of the table leg, with the table top independently attached to the apron sections. This method usually requires the use of multiple wood screws or other fasteners and is not easily disassembled for shipment and reassembled after shipment. In addition, use of the table and repeated assembly and disassembly will make the fasteners less effective and may result in a less sturdy table.

Interlocking castings have been used with one section of the casting attached to the end of an apron section and a complementary casting section attached to the upper end of the table leg. Separate brackets or other devices may be used to secure the table top to the apron sections. This method is complex in that two castings are needed at each apron section junction with the table leg. Also, a separate device is still needed to secure the apron section to the table top.

Thus a need exists for a table leg securement device that provides a sturdy table, can be packaged for economical shipment, and can be easily assembled and disassembled with a minimum of tools.

SUMMARY

The present invention solves these and other needs and problems by providing, in a first aspect, a device for securing a table leg to first and second apron sections and a table top. In the preferred form, members are provided on a corner block which are captured between the table top and the edges of the first and second apron sections for maintaining the first end of the corner block against the table top. The first end of the table leg is attached to the corner block. The first ends of the first and second apron sections engage the corner block and simultaneously force the first ends of the apron sections against the first end of the table leg while maintaining the longitudinal axis of the table leg perpendicular to the longitudinal axis of the first and second apron sections.

In another aspect of the present invention, hinges are provided for pivotally mounting the apron sections about axes parallel to the longitudinal axes of the apron sections between a first position with the edges of the apron sections perpendicular to the table top and a second position with the edges of the apron sections abutting the table top.

It is thus an object of the present invention to provide a novel device for securing apron sections to a table top and for securing a table leg to the apron sections.

It is further an object of the present invention to provide such a novel table leg securement device which can be shipped in a flat shipping carton to reduce the shipping cost for the table.

It is further an object of the present invention to provide such a novel table leg securement device which includes a small number of separate parts for ease of packaging and to reduce misplacement.

It is further an object of the present invention to provide such a novel table leg securement device which which is simple to assemble.

It is further an object of the present invention to provide such a novel table leg securement device which requires minimal tools to assemble.

It is further an object of the present invention to provide such a novel table leg securement device which requires minimal skills to assemble.

It is further an object of the present invention to provide such a novel table leg securement device which can be easily and economically manufactured without special tools.

It is further an object of the present invention to provide such a novel table leg securement device which which can be manufactured from readily available and low cost components.

It is further an object of the present invention to provide such a novel table leg securement device which can be easily disassembled, moved, and reassembled.

These and further objects and advantages of the present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
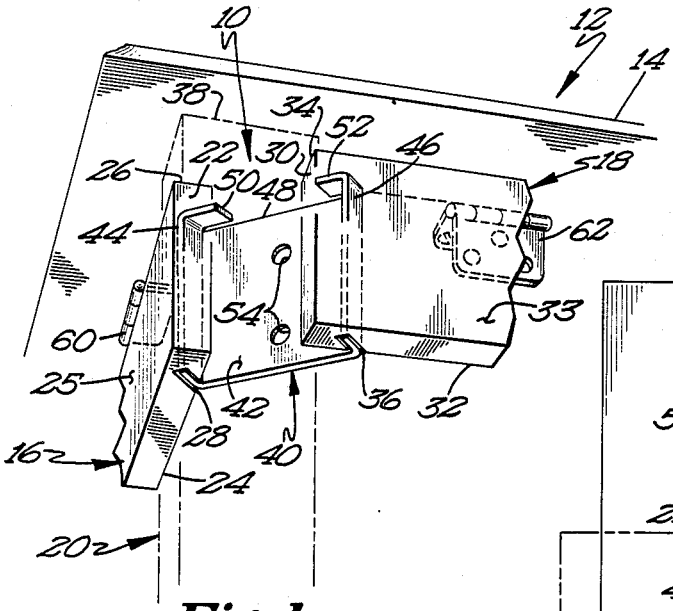
FIG. 1 shows a partial perspective view of a table leg securement device according to the preferred teachings of the present invention, with portions being shown in phantom.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "sides", "first", "second", "inside", "outside", "end", "face", "edge", and similar terms are used herein, it should be understood that these terms have reference only to the structure shown in the drawings as it would appear to a person viewing the drawings and are utilized only to facilitate describing the invention.

DESCRIPTION

A device for securing adjacent table apron sections to a table top and for securing a table leg to the apron sections and to the table top is shown in the drawings and is generally designated 10. A table 12 generally includes a table top 14, an apron partially shown in the drawings as a first apron section 16 and a second apron section 18 located adjacent to apron section 16, and table legs shown in the drawings as table leg 20, all of which are partially shown in the figures.

Figure 2:
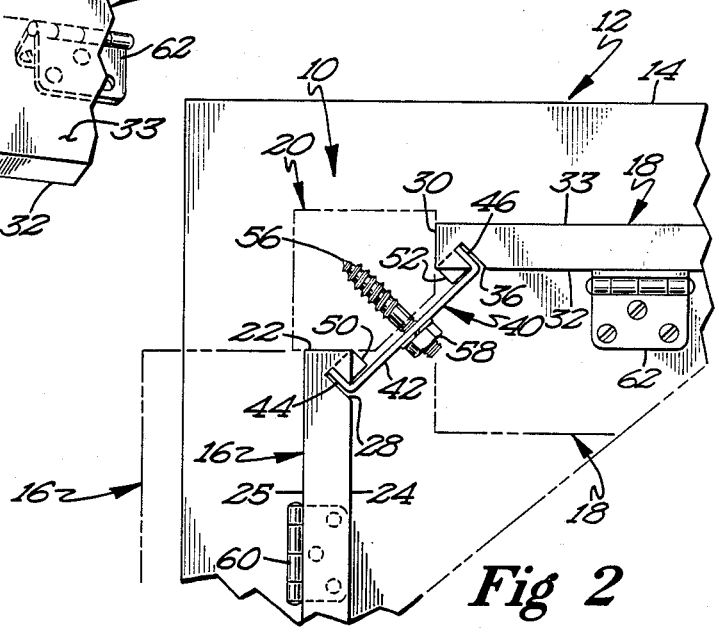
FIG. 2 shows a bottom plan view of the table leg securement device of FIG. 1, with the table leg and the first positions of the apron sections shown in phantom.
Figure 3:
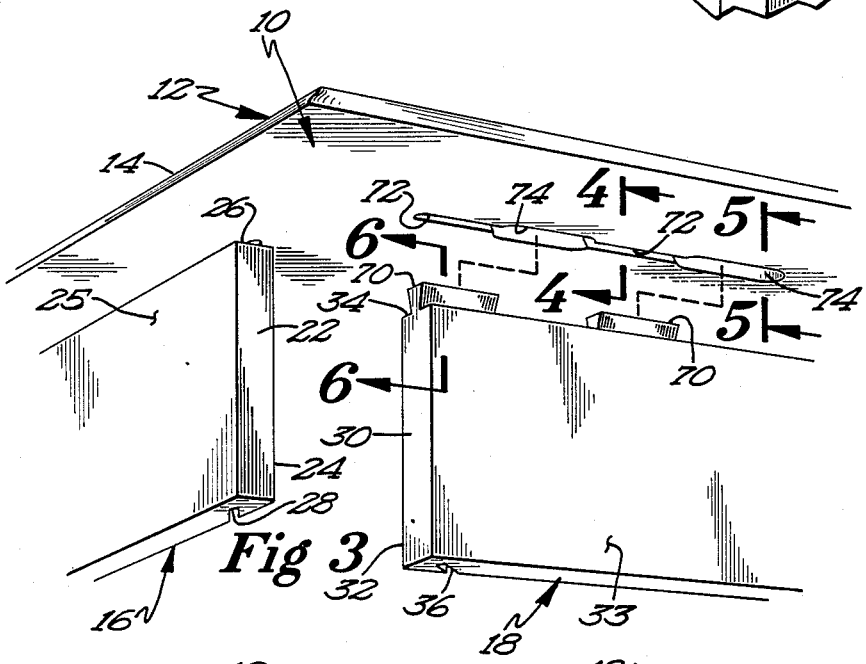
FIG. 3 shows an exploded perspective view of an alternate embodiment of a table leg securement device according to the teachings of the present invention.
Figure 4:
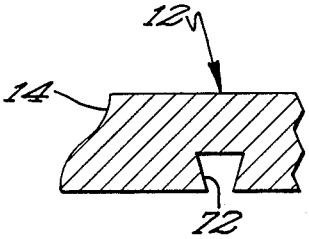
FIG. 4 shows a cross-sectional view of the table leg securement device of FIG. 3 according to section line 4—4 of FIG. 3.
Figure 5:
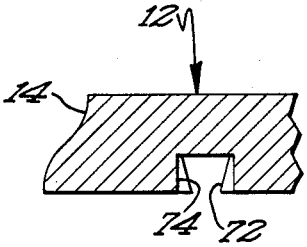
FIGS. 5 shows a cross-sectional view of the table leg securement device of FIG. 3 according to section line 5—5 of FIG. 3.
Figure 6:
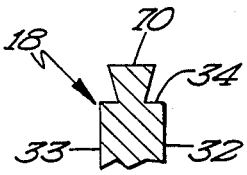
FIG. 6 shows a cross-sectional view of the table leg securement device of FIG. 3 according to section line 6—6 of FIG. 3.

In a first preferred form shown in FIGS. 1 and 2, device 10 according to the teachings of the present invention includes members for pivotably mounting first apron section 16 to table top 14 shown in its most preferred form as butt type hinge 60. Hinge 60 maintains the longitudinal axis of first apron section 16 parallel to table top 14. The pivotal mounting allows first apron section 16 to be placed in a first position or a second position. In its first position, inside face 24 is generally parallel to and spaced from table top 14, outside face 25 is generally parallel to and abuts table top 14, and edge 26 is generally perpendicular to table top 14. It may be noted that in the first position, first apron section 16 extends from the axis of hinge 60 in the direction away from the center of table top 14. In its second position, inside face 24 and outside face 25 of apron section 16 are generally perpendicular to table top 14 and edge 26 is generally parallel to and abuts table top 14.

In the first preferred form shown in FIGS. 1 and 2, device 10 according to the preferred teachings of the present invention also includes members for pivotably mounting second apron section 18 to table top 14 shown in its most preferred form as offset type hinge 62. Hinge 62 maintains the longitudinal axis of second apron section 18 parallel to table top 14. Second apron section 18 may be placed in a first position or a second position. In the first position, inside face 32 is generally parallel to and abuts table top 14, outside face 33 is generally parallel to and spaced from table top 14, and edge 34 is generally perpendicular to table top 14. In the first position, it may be noted that second apron section 18 extends from hinge 62 in the direction toward the center of table top 14. In its second position, inside face 32 and outside face 33 of apron section 18 are generally perpendicular to table top 14, and edge 34 is generally parallel to and abuts table top 14.

It may be noted by those experienced in the art that due to the most preferred construction of hinges 60 and 62 of butt and offset types, respectively, first apron section 16 and second apron section 18 may be simultaneously placed in the first position flat against table top 14 without either apron section striking or interfering with the other apron section. Similarly, first apron section 16 and second apron section 18 may be simultaneously moved from their first positions to their second positions without either apron section interfering with the other apron section.

Device 10 further includes a corner bracket or block 40 according to the teachings of the present invention. Corner block 40 is generally channel shaped having a web portion or bottom 42 and flange portions or sides 44 and 46 extending generally perpendicularly from the opposite sides of bottom 42. Bottom 42 of corner block 40 has holes 54 for the insertion of a fastener shaft 56 attached to first end 38 of table leg 20. According to the teachings of the present invention, fastener shafts 56 may be inserted through holes 54 in corner block 40 and fastener nut 58 may be threaded onto fastener shaft 56 to secure first end 38 of table leg 20 to corner block 40.

According to the teachings of the present invention, corner block 40 includes tabs 50 and 52 extending generally perpendicularly from first end 48 of corner block 40. Specifically, in the most preferred form, tabs 50 and 52 are integrally formed on and generally perpendicular to sides 44 and 46, respectively, with tab 50 pointing toward tab 52 and tab 52 pointing toward tab 50. It can be appreciated that tabs 50 and 52 are also generally perpendicular to bottom 42 of corner block 40.

An angled slot 28 is formed in apron section 16 extending from edge 26 to the opposite edge and extending from inside face 24 at an angle for receiving side 44 of corner block 40. Similarly, an angled slot 36 is formed in apron section 18 extending from edge 34 to the opposite edge and extending from inside face 32 at an angle for receiving side 46 of corner block 40. It can then be appreciated that slots 28 and 36 are parallel to each other when apron sections 16 and 18 are in their second positions as best seen in FIG. 2, with slots 28 and 36 being spaced a distance generally equal to the width of bottom 42 between sides 44 and 46 of corner block 40. In the form shown in the drawings with the longitudinal axes of apron sections 16 and 18 being perpendicular, the angles of slots 28 and 36 are in the range of 45° towards ends 22 and 30, respectively.

Now that the basic construction of table leg securement device 10 according to the teachings of the present invention has been disclosed, the method of use and subtle features of table leg securement device 10 according to the teachings of the present invention can be set forth and appreciated. To illustrate the operation, use, and advantages of table leg securement device 10 according to the teachings of the present invention, it will be assumed that a customer has ordered and received table 12 which utilizes the present invention.

The customer will receive table 12 packaged in a flat shipping carton. Within the shipping carton, first apron section 16 will be in the first position with apron section 16 folded flat against table top 14. Specifically, edge 26 of first apron section 16 will be generally perpendicular to table top 14 and inside face 24 of first apron section 16 will be generally parallel to and spaced from table top 14. Also, second apron section 18 will be positioned in the first position with apron section 18 folded flat against table top 14. Specifically, edge 34 of second apron section 18 will be generally perpendicular to table top 14 and inside face 32 of apron section 18 will be generally parallel to and abutting table top 14.

The customer may remove table 12 from the shipping carton and proceed to complete the assembly of table 12. Table top 14 may be placed on a flat surface with first apron section 16 and second apron section 18 being on the exposed upper side. First apron section 16 may be rotated about the axis of hinge 60 to its second position with inside face 24 of apron section 16 generally perpendicular to table top 14. Second apron section 18 may be rotated about the axis of hinge 62 to its second position with inside face 32 of apron section 18 generally perpendicular to table top 14.

Corner block 40 may then be positioned with side 44 of corner block 40 inserted in slot 28 of first apron section 16 and side 46 inserted in slot 36 of second apron section 18 and with tab 50 located between edge 26 of first apron section 16 and table top 14 and tab 52 located between edge 34 of second apron section 18 and table top 14. It may be appreciated that tab 50 is captured between edge 26 and table top 14 and that tab 52 is captured between edge 34 and table top 14.

Table leg 20 may then be positioned with fastener shafts 56 extending through holes 54 and first end 22 of first apron section 16 and first end 30 of second apron section 18 abutting first end 38 of table leg 20. Fastener nuts 58 may then be turned onto fastener shafts 56 to secure first end 38 of table leg 20 to corner block 40. It may be appreciated that as fastener nuts 58 are tightened against corner block 40, sides 44 and 46 of corner block 40 which are engaged by slot 28 in first apron section 16 and slot 36 in second apron section 18, respectively, will force first end 22 of first apron section 16 and first end 30 of second apron section 18 against first end 38 of table leg 20. It may be appreciated by those knowledgeable in the art that as fastener nut 58 is tightened against corner block 40, corner block 40 simultaneously forces the first ends 22 and 30 of the first and second apron sections 16 and 18 against the first end 38 of the table leg 20 while maintaining the longitudinal axis of the table leg 20 perpendicular to the longitudinal axes of the first and second apron sections 16 and 18.

An alternate embodiment of device 10 according to the teachings of the present invention is shown in FIGS. 3–6. In the preferred form, edge 26 of first apron section 16 and edge 34 of second apron section 18 include dovetail projections 70. Table top 14 includes dovetail grooves 72 connected to antichambers 74. Antichambers 74 are sized to receive the widest portion of dovetail projections 70. Dovetail grooves 72 are adapted to slideably receive and capture the widest portion of dovetail projections 70. In use, apron section 16 and 18 may be shipped flat in a first position, with the inside or outside faces 24, 25, 32, or 33 abutting table top 14 and with edges 26 and 34 being generally perpendicular to table top 14. To assemble table 12, apron sections 16 and 18 may be positioned with their longitudinal axes parallel to table top 14 and with dovetail projections 70 extending into antichambers 74. Apron sections 16 and 18 may then be moved along their longitudinal axes toward dovetail grooves 72 so that dovetail projections 70 engage and are captured in dovetail grooves 72. Apron sections 16 and 18 are then in their second position, with inside and outside faces 24, 25, 32, and 33 being generally perpendicular to table top 14 and with edges 26 and 34 being parallel to and abutting table top 14. It can then be appreciated that corner block 40 engaged within slots 28 and 36 prevent apron sections 16 and 18 from sliding along their longitudinal axes when table 12 is assembled to prevent removal of dovetail projections 70 from dovetail grooves 72.

Now that the construction and operation of device 10 have been set forth, many advantages can be further set forth and appreciated. In the past, the size and shape of the shipping carton for partially assembled tables has required high shipping costs, lengthy shipping times, and access to only certain methods of shipping. Furniture manufacturers can better meet the needs of their customers if the size and shape of the table shipping carton allow the manufacturer access to less costly and faster shipping means.

Through the use of device 10 according to the teachings of the present invention, an occasional table may be packaged for shipment in a flat, compact shipping carton acceptable by a common carrier or national parcel service and which does not require special handling. This flat carton may be economically shipped directly to an ordering customer. The customer will benefit from the lower shipping cost and quicker delivery.

Device 10 according to the teachings of the present invention provides an easy foolproof method of securing adjacent apron sections 16 and 18 and table leg 20 to table top 14. Only a few simple instructions need be provided to the customer since the method of assembly will be obvious to many customers. It may be apparent to those experienced in the art that multiple assembly tools such as screwdrivers, wrenches and the like will not be required for device 10. A table utilizing device 10 according to the teachings of the present invention may be assembled with no tools other than a pliers or single wrench to perform the final tightening of fastener nuts 58 onto fastener shafts 56.

The advantages of a compact shipping package, simplicity, and ease of assembly gained by device 10 according to the teachings of the present invention extend beyond the initial shipping and assembly of the table. In a mobile society, people are frequently moving to different housing. This may be due to the opportunity for employment, when an employer transfers an employee, for reasons of health, or for personal choice reasons. Device 10 according to the teachings of the present invention will similarly offer advantages when a person is moving. Tables 12 utilizing device 10 may be easily disassembled and repackaged in a flat shipping carton for moving to the new location. Where repackaging is not warranted, the small number of separate table parts may be easily kept together to prevent misplacement or loss. After the person arrives at the new housing location, the table may again be easily assembled with a minimum of labor.

According to the teachings of the present invention, device 10 may be manufactured from simple, readily available and low cost components. Specifically, commercially available types of hinges may be utilized for hinges 60 and 62. Dovetail projections 70, dovetail grooves 72 and antichambers 74 may be formed with ordinary woodworking machinery employed by furniture manufacturers. Corner block 40 may be formed by stamping or bending a single, flat piece of metal with ordinary metal working machinery. Thus, it may be appreciated that no investment in special tools need be made in order to manufacture device 10.

It can then be appreciated that device 10 according to the teachings of the present invention allows the use of a flat and compact shipping carton. Further, a table utilizing device 10 may be easily assembled or disassembled.

It can also be appreciated that corner block 40 according to the teachings of the present invention performs multiple functions and is particularly advantageous according to the teachings of the present invention. First, corner block 40 may function to accurately locate first apron section 16 and second apron section 18 in their second positions with inside face 24 of first apron section 16 and inside face 32 of second apron section 18 generally perpendicular to table top 14. Additionally, first end 38 of table leg 20 is secured to corner block 40 by fastener shaft 56 and fastener nut 58. Further, tab 50 captured between edge 26 and table top 14 and tab 52 captured between edge 34 and table top 14 maintain first end 48 of corner block 40 against table top 14 without attachment thereto and thus secure table leg 20 to apron sections 16 and 18. Additionally, tightening fastener nut 58 onto fastener shaft 56 forces first end 20 of first apron section 16 and first end 30 of second apron section 18 against first end 38 of table leg 20, with apron sections 16 and 18 providing effective alignment and bracing for table leg 20.

Now that the basic teachings of the present invention have been explained, many extensions and variations will be obvious to one having ordinary skill in the art. For example, it can be appreciated that while table 12 with adjacent apron sections 16 and 18 perpendicular to each other was used to illustrate the present invention, it should be understood that adjacent apron sections 16 and 18 at other angles of intersection may be used. Similarly, it can be realized that the number, type, and style of hinges 60 and 62 can be varied according to the teachings of the present invention.

Likewise, table leg 20 may have other shapes in addition to the straight, rectangular cross section shown in the preferred form of the present invention.

Additionally, fastener shaft 56 and fastener nut 58 may take other forms according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for securing first and second apron sections to a table top and to a table leg, with the first apron section having a longitudinal axis parallel to the table top, an edge, and a first end, with the second apron section having a longitudinal axis parallel to the table top, an edge, and a first end, with the table leg having a longitudinal axis and a first end, comprising, in combination: means for placing the first apron section in a first position with the edge of the first apron section generally perpendicular to the table top and in a second position with the edge of the first apron section abutting the table top; means for placing the second apron section in a first position with the edge of the second apron section generally perpendicular to the table top and in a second position with the edge of the second apron section abutting the table top; a corner block having a first end, with the corner block having means captured between the table top and the edges of the first and second apron sections in their second position for maintaining the first end of the corner block against the table top; means for attaching the first end of the table leg to the corner block; and means located on the first ends of the first and second apron sections for engaging the corner block and for simultaneously forcing the first ends of the apron sections against the first end of the table leg while maintaining the longitudinal axis of the table leg perpendicular to the longitudinal axes of the first and second apron sections.

2. The device of claim 1 wherein the means for placing the apron sections in the first position and in the second position comprises hinge means.

3. The device of claim 2 wherein the first apron section includes an inside face; wherein the second apron section includes an inside face; wherein the hinge means comprises, in combination: a first hinge for pivotally mounting the first apron section between the first position with the inside face being generally parallel to and spaced from the table top and the second position with the inside face being generally perpendicular to the table top, and a second hinge for pivotally mounting the second apron section between the first position with the inside face being generally parallel to and abutting the table top and the second position with the inside face being generally perpendicular to the table top.

4. The device of claim 3 wherein the first hinge for the first apron section is an offset hinge and the second hinge for the second apron section is a butt hinge.

5. The device of claim 1 wherein the means for placing the apron sections in the first position and in the second position comprises, in combination: dovetail projections formed on the edges of the apron sections parallel to the longitudinal axes of the apron sections; and dovetail grooves and communicating antichambers formed in the table top, with the dovetail grooves sized to slideably receive the dovetail projections through the antichambers.

6. The device of claim 1 wherein the means captured between the table top and the edges of the apron sections comprises, in combination: at least one tab extending generally perpendicularly from the first end of the corner block and captured between the table top and the edge of at least one of the first and second apron sections in their second position.

7. The device of claim 6 wherein the means for attaching the first end of the table leg to the corner block comprises, in combination: at least one hole in the corner block for attaching the table leg to the corner block with a fastener.

8. The device of claim 6 wherein the corner block has a channel-shaped cross section and includes a web portion and first and second flange portions extending from and on opposite sides of the web portion; wherein the engaging and simultaneously forcing means comprises, in combination: a first slot formed in the first end of the first apron section; a second slot formed in the first end of the second apron section, with the first and second slots being spaced and having a depth for receipt of the flange portions of the corner block, with the first and second flange portions of the corner block located in the first and second slots simultaneously forcing the first ends of the first and second apron sections against the first end of the table leg while maintaining the longitudinal axis of the table leg perpendicular to the longitudinal axes of the first and second apron sections.

9. The device of claim 8 wherein the first and second flange portions of the corner block are parallel and extend generally perpendicularly from the bottom of the corner block; wherein the first and second apron sections have inside faces, with the first slot extending from the inside face of the first apron section at an angle and with the second slot extending from the inside face of the second apron section at an angle, with the first slot being parallel to the second slot when the first and second apron sections are in their second position.

10. The device of claim 9 wherein the longitudinal axis of the first apron section is perpendicular to the longitudinal axis of the second apron section, with the angle of the first slot in the first apron section being in the range of 45° and the angle of the second slot in the second apron section being in the range of 45°.

11. Device for securing a table leg to first and second apron sections and a table top, with the first apron section having a longitudinal axis parallel to the table top, an edge, and a first end, with the second apron section having a longitudinal axis parallel to the table top, an edge and a first end, with the table leg having a longitudinal axis and a first end, with the edges of the apron sections abutting the table top comprising, in combination: a corner block having a first end, with the corner block having means captured between the table top and the edges of the first and second apron sections for maintaining the first end of the corner block against the table top; means for attaching the first end of the table leg to the corner block; and means located on the first ends of the first and second apron sections for engaging the corner block and for simultaneously forcing the first ends of the apron sections against the first end of the table leg while maintaining the longitudinal axis of the table leg perpendicular to the longitudinal axes of the first and second apron sections.

12. The device of claim 11 wherein the means captured between the table top and the edges of the apron sections comprises, in combination: at least one tab extending generally perpendicularly from the first end of the corner block and captured between the table top and the edge of at least one of the first and second apron sections.

13. The device of claim 12 wherein the means for attaching the first end of the table leg to the corner block comprises, in combination: at least one hole in the corner block for attaching the table leg to the corner block with a fastener.

14. The device of claim 12 wherein the corner block has a channel-shaped cross section and includes a web portion and first and second flange portions extending from and on opposite sides of the web portion; wherein the engaging and simultaneously forcing means comprises, in combination: a first slot formed in the first end of the first apron section; a second slot formed in the first end of the second apron section, with the first and second slots being spaced and having a depth for receipt of the flange portions of the corner block, with the first and second flange portions of the corner block located in the first and second slots simultaneously forcing the first ends of the first and second apron sections against the first end of the table leg while maintaining the longitudinal axis of the table leg perpendicular to the longitudinal axes of the first and second apron sections.

15. The device of claim 14 wherein the first and second flange portions of the corner block are parallel and extend generally perpendicularly from the bottom of the corner block; wherein the first and second apron sections have inside faces, with the first slot extending from the inside face of the first apron section at an angle and with the second slot extending from the inside face of the second apron section at an angle, with the first slot being parallel to the second slot.

16. The device of claim 15 wherein the longitudinal axis of the first apron section is perpendicular to the longitudinal axis of the second apron section, with the angle of the first slot in the first apron section being in the range of 45° and the angle of the second slot in the second apron section being in the range of 45°.

17. Device for securing first and second apron sections to a table top and to a table leg, with the first apron section having a longitudinal axis parallel to the table top, an edge, and a first end, with the second apron section having a longitudinal axis parallel to the table top, an edge and a first end, with the table leg having a longitudinal axis and a first end, comprising, in combination: first hinge means for pivotally mounting the first apron section about an axis parallel to the longitudinal axis of the first apron section between a first position with the edge of the first apron section being generally perpendicular to the table top and a second position with the edge of the first apron section abutting the table top; second hinge means for pivotally mounting the second apron section about an axis parallel to the longitudinal axis of the second apron section between a first position with the edge of the second apron section being generally perpendicular to the table top and a second position with the edge of the second apron section abutting the table top; and means for attaching the first end of the table leg to the first and second apron sections.

18. The device of claim 17 wherein the attaching means comprises, in combination: a corner block having a first end; means for attaching the first end of the table leg to the corner block; and means located on the first ends of the first and second apron sections for engaging the corner block and for simultaneously forcing the first ends of the apron sections against the first end of the table leg while maintaining the longitudinal axis of the table leg perpendicular to the longitudinal axes of the first and second apron sections.

19. The device of claim 17 wherein the first apron section includes an inside face; wherein the second apron section includes an inside face; wherein the first hinge means comprises, in combination: a first hinge for pivotally mounting the first apron section between the first position with the inside face being generally parallel to and spaced from the table top and the second position with the inside face being generally perpendicular to the table top; and wherein the second hinge means comprises, in combination: a second hinge for pivotally mounting the second apron section between the first position with the inside face being generally parallel to and abutting the table top and the second position with the inside face being generally perpendicular to the table top.

20. The device of claim 19 wherein the first hinge for the first apron section is an offset hinge and the second hinge for the second apron section is a butt hinge.

* * * * *